US005379614A

United States Patent [19]

Igarashi

[11] Patent Number: 5,379,614

[45] Date of Patent: Jan. 10, 1995

[54] DUST AND WASTE REMOVAL AND COLLECTION SYSTEM FOR DOUBLE KNITTING MACHINE

[75] Inventor: Yoshiaki Igarashi, Kobe, Japan

[73] Assignee: Precision Fukuhara Works, Ltd., Hyogo, Japan

[21] Appl. No.: 116,353

[22] Filed: Sep. 2, 1993

[30] Foreign Application Priority Data

Sep. 18, 1992 [JP] Japan ..... 4-275449

[51] Int. Cl.[6] ..... D04B 35/32

[52] U.S. Cl. ..... 66/168; 66/8; 15/301

[58] Field of Search ..... 66/8, 168; 15/300.1, 15/301, 312.1

[56] References Cited

U.S. PATENT DOCUMENTS

| | | | |
|---|---|---|---|
| 2,582,092 | 1/1952 | Ancot | 15/301 X |
| 3,018,603 | 1/1962 | Rutz et al. | 15/301 X |
| 3,274,803 | 9/1966 | Schmidt | 66/168 |
| 3,378,998 | 4/1968 | Shackleford | 15/301 |
| 4,703,632 | 11/1987 | Izumi et al. | 66/168 |
| 4,718,253 | 1/1988 | Lonati | 66/168 X |
| 4,765,158 | 8/1988 | Goller et al. | 66/168 |
| 4,926,531 | 5/1990 | Koslowski | 15/301 X |
| 5,177,985 | 1/1993 | Igarashi et al. | 66/168 |

FOREIGN PATENT DOCUMENTS

| | | | |
|---|---|---|---|
| 0458258 | 5/1992 | European Pat. Off. | 66/168 |
| 806279 | 6/1951 | Germany | 15/300.1 |
| 1560928 | 3/1970 | Germany . | |
| 1585177 | 10/1970 | Germany . | |
| 2448765 | 4/1976 | Germany . | |
| 489653 | 4/1970 | Switzerland . | |
| 555918 | 11/1974 | Switzerland | 66/168 |
| 1160660 | 8/1969 | United Kingdom . | |

*Primary Examiner*—Clifford D. Crowder
*Assistant Examiner*—John J. Calvert
*Attorney, Agent, or Firm*—Bell, Seltzer, Park & Gibson

[57] ABSTRACT

A dust removal and collection system which includes a suction fan for creating upwardly and inwardly flowing air streams through a knitting section and a yarn feeding and guiding device for removing dust and other fiber waste from the components thereof. An airstream receiving and confining hood overlies the knitting section and defines therethrough an air passageway. An entrance end of the air passageway is disposed radially outwardly of and above the knitting section so that the upwardly flowing air stream flows outwardly of the knitting section to carry dust and other fiber waste entrained therein upwardly and outwardly from the knitting components such that no dust or other fiber waste will return to the knitting components. A waste collection device cooperates with the hood to receive and collect the dust and other fiber waste removed from the double knitting machine.

17 Claims, 2 Drawing Sheets

DUST AND WASTE REMOVAL AND COLLECTION SYSTEM FOR DOUBLE KNITTING MACHINE

CROSS-REFERENCE TO RELATED MATTERS

This invention constitutes an improvement upon the dust collection systems for circular knitting machines disclosed in the commonly owned U.S. Pat. No. 5,177,985, issued Jan. 12, 1993 and co-pending patent applications Ser. No. 08/024,508, filed Mar. 2, 1993, and Ser. No. 07/940,512, filed Sep. 4, 1992.

FIELD OF THE INVENTION

This invention relates to the removal and collection of dust and other waste from the components of circular knitting machines and more particularly to the removal thereof from double knitting machines.

BACKGROUND OF THE INVENTION

The operation of circular knitting machines, particularly the yarn feeding, yarn guiding and knitting components thereof, generates considerable dust, lint or fiber waste and other waste. The generation of such waste is particularly acute when cotton yarns are being knitted. Further, knitting machines are now being operated at ever increasing speeds which exacerbate the waste generation problem.

Unless removed, such dust or other waste will collect on the various machine components and on the yarns and knitted fabric. Invariably, such waste will adversely affect machine operation and knit fabric quality.

Previously proposed dust and other waste removal systems, such as fans or air blowers above the knitting machines and exhaust ducts into which operators direct collected waste, have been unsuccessful in solving the waste problem in knitting machines. The dust removal and collection systems disclosed in the commonly owned U.S. Pat. No. 5,177,985 and the above-identified co-pending applications have proven to improve greatly the dust removal as well as the collection thereof on circular knitting machines of the single knit type having needles only in the cylinder of the knitting machine.

Double knitting machines have needles in the cylinder and needles in a dial cooperating with the cylinder needles in producing a double knit fabric. Such double knitting machines have particular dust and waste generation problems that are distinct from other circular knitting machines.

SUMMARY OF THE INVENTION

With the foregoing in mind, it is an object of the present invention to provide a dust and other waste removal and collection system for double knitting machines which overcomes the disadvantages and deficiencies of prior waste removal systems and effectively removes and collects dust and other waste from the components of a double knitting machine.

This object of the present invention is accomplished by providing a waste removal and collection system including a suction fan mounted above the cylinder and dial of a double knitting machine for creating an air stream flowing upwardly across the knitting components of the cylinder and inwardly across the yarn feed and yarn guiding components of the double knitting machine. An air stream confining hood overlies and extends outwardly beyond the outer periphery of the needle cylinder and dial of the double knitting machine to receive and confine the upwardly flowing air stream and dust and other waste entrained therein. A circularly movable fan or other air blowing means moves around the knitting machine blowing air inwardly across the yarn feeding and yarn guiding components to assist the suction fan in removing dust and other waste therefrom. A waste collection system communicates with the suction fan to receive the air stream and entrained waste from the suction fan and to separate the waste from the air stream.

In the drawings and specifications, there has been set forth a preferred embodiment of the invention, and although specific terms are employed, they are used in a generic and descriptive sense only and not for purposes of limitation.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE PREFERRED EMBODIMENT

Figure 1:
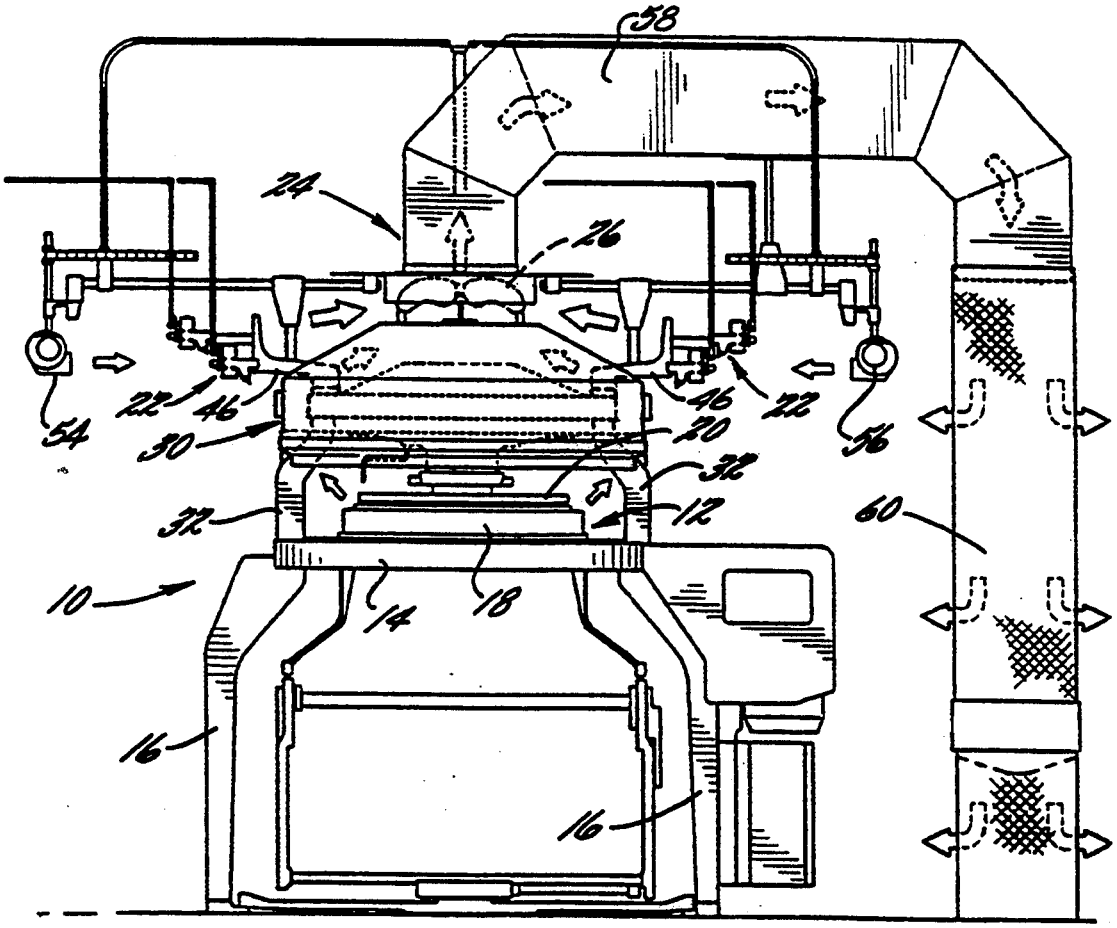
FIG. 1 is an elevational view of a double knitting machine incorporating the dust and waste removal and collection system of the present invention.

Referring now more specifically to the drawing, there is illustrated therein a double knitting machine 10 having a knitting section 12 that extends upwardly from a bed 14 which in turn is supported by a plurality of frame members or legs 16. As is well known, the knitting section 12 of the double knitting machine 10 includes a needle cylinder 18 and a needle dial 20. Needle cylinder 18 has cylinder needles (not shown) vertically slidable in a multiplicity of needle grooves formed in the outer periphery of needle cylinder 18. On the other hand, dial 20 has dial needles (also not shown) radially slidable in a multiplicity of needle grooves in the dial 20.

The cylinder 18 and dial 20 rotate at a synchronized speed by a drive means (not shown) with which the double knitting machine 10 is conventionally equipped. During such rotation, the knitting section 12 is supplied with yarns from a creel (not shown) by yarn feeding and guiding means 22 in a manner that is well known. The knitting section 12 and yarn feeding and guiding means 22 generate dust and other fiber waste during operation thereof.

In accordance with the present invention, such dust and other fiber waste is removed by a fiber waste removal and collection system, generally indicated at 24, which partially overlies the knitting section 12. System 24 includes a suction fan 26 confined within a housing 28 which is open at the bottom thereof. Fan 26 is driven by a motor 29 to create an air stream flowing upwardly through and across knitting section 12 including the cylinder 18 and dial 20 and an air stream flowing inwardly across the yarn feeding and guiding means 22.

System 24 further includes an air stream confining or suction hood 30 which overlies the knitting section 12 and is supported from bed 14 by secondary frame members 32. Hood 30 includes a generally cylindrical section 34 which is of a diameter generally consistent with the diameter of the bed 14 such that the hood 30 overlies and surrounds the knitting section 12 to capture and confine substantially all of the upwardly flowing air stream and waste entrained therein. Hood 30 further includes a frusto-conical section 36 which extends upwardly and inwardly from cylindrical section 34 to a position immediately below but spaced from the open bottom of housing 28 of suction fan 26. Frusto-conical section 36 has an opening 38 at its upper terminus such that the interior of hood 30 communicates with fan 26.

Suction hood 30 also includes a second, internal frusto-conical section or member 40 which is solid and is spaced inwardly of frusto-conical section 36 to define a restricted circumferential air passageway 42 through hood 30. Because the suction hood 30 is of greater diameter than the knitting section 12 and because of the presence of the member 40 therein, the upwardly flowing air stream passing across the knitting section 12 moves radially outwardly thereacross and carries all entrained dust and other fiber waste upwardly and outwardly beyond the periphery of knitting section 12 before the air stream and entrained fiber waste passes into the air passageway 42.

Figure 3:
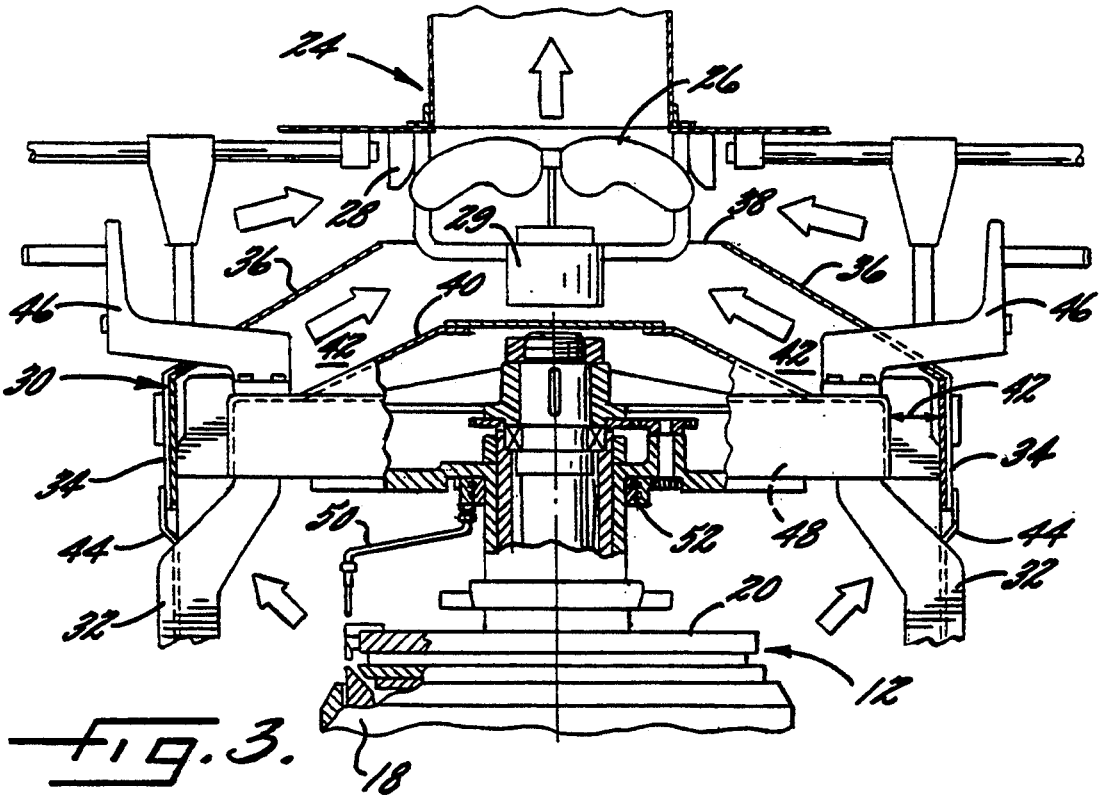
FIG. 3 is an enlarged, fragmentary vertical sectional view taken substantially along line 3—3 in FIG. 2.

While not required in some instances, it is preferred that a door or movable extension 44 be provided between the lower end of cylindrical section 34 and the top of the bed 14 (as seen in FIG. 3) to enclose completely the knitting section 12. The door or movable extension 44 should be constructed to have movable panels or sections to provide access to the knitting section 12 as needed for proper operation thereof.

As illustrated, hood 30 is polygonal in plan and is formed of twelve (12) interconnected sections. However, hood 30 may be of any suitable construction and configuration, such as cylindrical.

Figure 4:
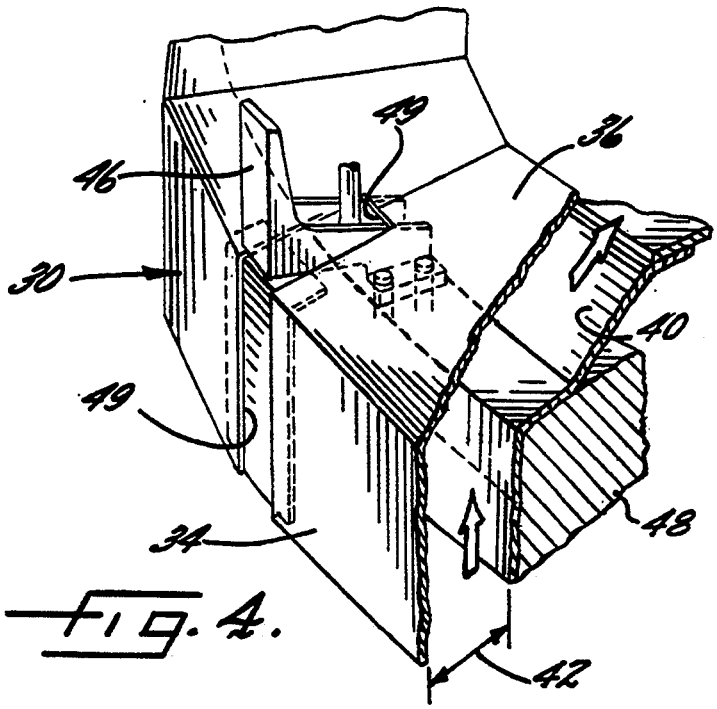
FIG. 4 is an enlarged fragmentary perspective view of a peripheral portion of the air stream confining hood of the dust and other waste removal and collection system of this invention.
Figure 2:
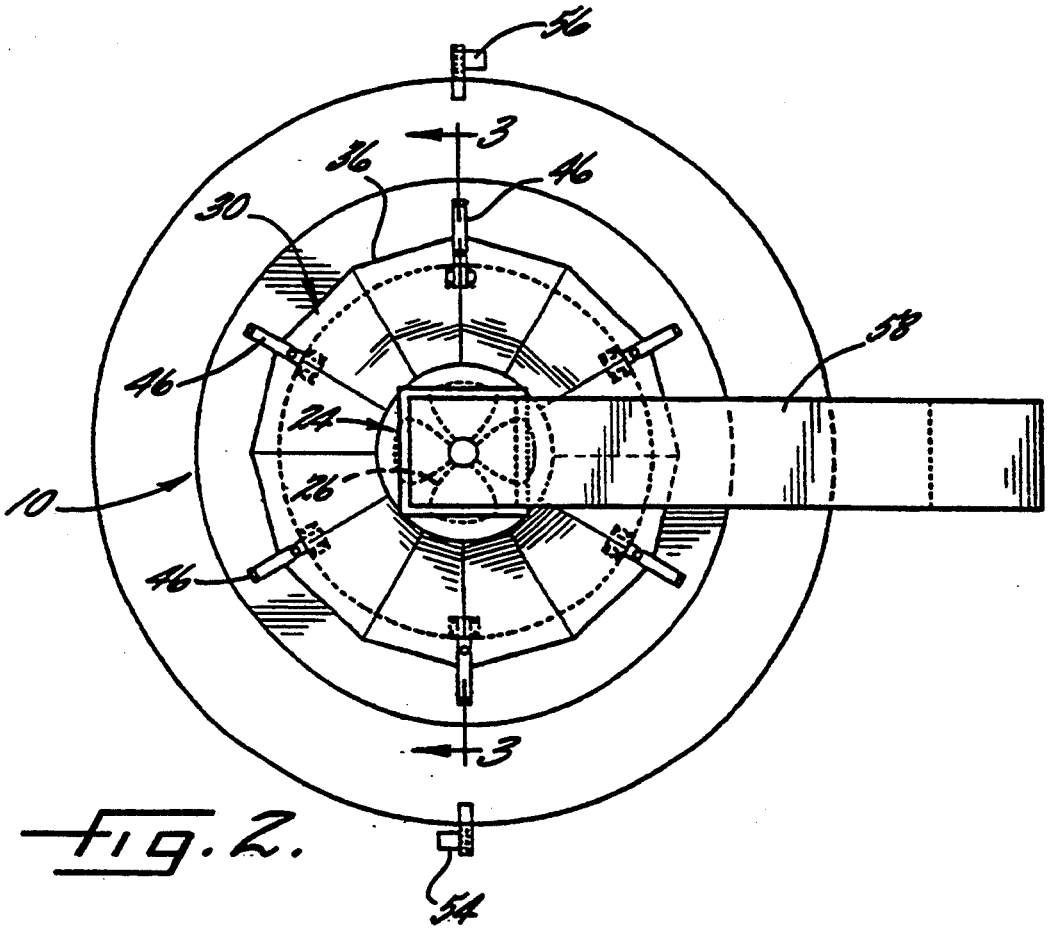
FIG. 2 is a top plan view of the knitting machine shown in FIG. 1.

Provision must also be made for the support of the yarn feeding and guiding means 22. As illustrated in FIGS. 1 and 4, support brackets 46 are mounted on a head part 48 of knitting machine 10 and extend upwardly and outwardly therefrom. Brackets 46 pass through openings 49 in frusto-conical section 36 of hood 30 to the yarn feeding and guiding means 22.

While not shown, hood 30 must also be provided with suitable access openings between yarn feeding and guiding means 22 and the knitting section 12. The location and configuration of such access openings will depend upon the particular yarn feeding and guiding means 22 with which knitting machine 10 is equipped and will be well within the skill of knitting technicians.

To assist suction fan 26 in the removal of fiber waste from knitting section 12, it is preferred that an air jet 50 be provided within hood 30 for blasting air against the knitting components of needle cylinder 18 and dial 20. A mounting and drive mechanism 52 for air jet 50 is carried by head part 48 (FIG. 3). The air jet 50 and its mounting and drive mechanism 52 are more particularly and specifically described in commonly owned U.S. Pat. No. 4,703,632, issued Nov. 3, 1987, the disclosure of which is incorporated herein by reference.

Similarly, a pair of traveling blowers or fans 54, 56 are mounted outwardly of the yarn feeding and guiding means 22 for blowing relatively high velocity air streams inwardly across the yarn feeding and guiding means. These high velocity air streams assist suction fan 26 in removing fiber waste from the yarn feeding and guiding means 22 and in conveying such waste into fan housing 28. Blowers or fans comparable to blowers 54, 56 and the mounting and driving means therefor are specifically disclosed in the commonly owned U.S. Pat. No. 5,177,985, issued Jan. 12, 1993, which disclosure is incorporated herein by reference.

Once the dust and other fiber waste has been removed and entrained in the moving air streams created by suction fan 26, assisted by air jet 50 and blowers 54, 56, a duct 58 is connected at one end to the discharge end of suction fan housing 28 and at its other end to a dust and other fiber waste collection means 60. Duct 58 is preferably formed of sheet metal and waste collection means 60 is formed of a foraminous material to permit air to escape therethrough while entrapping and collecting the dust and fiber waste in collection means 60. Duct 58 and waste collection means 60 are more specifically disclosed in the commonly owned, co-pending application, Ser. No. 08/024,508, filed Mar. 2, 1993, which disclosure is incorporated herein by reference.

In operation, the double knitting machine produces double knit cloth by knitting yarns on the cylinder needles and the dial needles. The yarns are supplied to the cylinder and dial needles by the yarn feeding and guiding means 22. Considerable dust and other fiber waste is generated by the knitting section 12 and by the yarn feeding and guiding means 22.

The dust and other fiber waste removal and collection system 24 removes and collects such dust and other fiber waste in an improved and highly efficient manner. The dust and other fiber waste is removed from knitting section 12 by the suction fan 26 assisted by the air jet 50.

Because the air passageway 42 within hood 30 is positioned radially outwardly of knitting section 12, the upwardly flowing air stream created by suction fan 26 flows outwardly beyond the periphery of knitting section 12, thereby carrying the entrained dust and other fiber waste not only upwardly from but outwardly of the knitting components of the knitting section 12. Therefore, if any of the fiber waste drops out of the air stream, it will not fall back onto the knitting section 12. Also, the surrounding relationship of hood 30 to the knitting section 12, particularly if the door or extension 44 is utilized, confines the air stream's outward travel and obviates the need for curtains or other partitions between adjacent knitting machines. The frusto-conical shape of hood 30 confines and deflects the upwardly flowing air stream directly into suction fan housing 28 and past suction fan 26.

An inwardly flowing air stream is created by suction fan 26 assisted by blowers 54, 56. This inwardly flowing air stream removes dust and other fiber waste from the yarn feeding and guiding means 22 and other associated machine components. Because the yarn feeding and guiding means 22 are located radially outwardly of the knitting section 12, the inwardly moving air stream takes the entrained dust and other fiber waste away from these knitting machine components. The hood 30 protects the knitting section 12 from any dust or other fiber waste that may drop from the inwardly flowing air stream.

The inwardly flowing air stream enters the open bottom of suction fan housing 28 between such housing and the hood 30 and merges with the upwardly flowing air stream from the hood 30. The merged air streams then pass through the duct 58 and into the waste collection means 60. The air escapes from the waste collection means 60 but the dust and other fiber waste is entrapped therein and collected for subsequent disposal.

In the drawings and specifications, there has been set forth a preferred embodiment of the invention, and although specific terms are employed, they are used in generic and descriptive sense only and not for purpose of limitation.

That which is claimed is:

1. In a double knitting machine having a knitting section comprising a needle cylinder, cylinder needles mounted in said needle cylinder, a dial mounted above and in operative association with said needle cylinder, dial needles mounted in said dial and cooperating with said cylinder needles, and yarn feeding and guiding means for supplying yarns to said cylinder needles and said dial needles to form double knit fabric, the combination therewith of a dust and other fiber waste removal system comprising (a) suction fan means mounted above said knitting section for creating an upwardly flowing air stream through and across said needle cylinder and said dial to remove dust and other fiber waste therefrom, and (b) hood means overlying said knitting section and extending outwardly beyond the periphery of said needle cylinder and said dial, said hood means defining a restricted air passageway therethrough communicating with said suction fan means at one end thereof and terminating in an ingress end at the other end thereof, said ingress end of said air passageway being located radially outwardly of and above said knitting section so that the air stream created by said suction fan means flows upwardly from and outwardly of said knitting section, whereby dust and other fiber waste is removed from said knitting section and is carried outwardly beyond the periphery of said knitting section.

2. A double knitting machine according to claim 1 wherein said hood means extends in surrounding spaced relation to said knitting section to confine the upwardly and outwardly flowing air stream to the immediate vicinity of said knitting section and to direct the air stream into the ingress end of said air passageway.

3. A double knitting machine according to claim 2 wherein said hood means has access means adjacent said knitting section to provide operator access to said knitting section.

4. A double knitting machine according to claim 1 including air jet means operatively associated with said knitting section for blasting said knitting section with a high velocity air stream to assist said suction fan means in removing dust and other fiber waste from said knitting section.

5. A double knitting machine according to claim 4 including means for mounting said air jet means for movement circumferentially around said knitting section, and drive means for moving said air jet means.

6. A double knitting machine according to claim 1 wherein said suction fan is located inwardly of said yarn feeding and guiding means and creates a second air stream flowing inwardly across said yarn feeding and guiding means for removing dust and other fiber waste therefrom.

7. A double knitting machine according to claim 6 including blower means located externally of said yarn feeding and guiding means for blowing high velocity air inwardly across said yarn feeding and guiding means to assist said suction fan means in removing dust and other fiber waste therefrom.

8. A double knitting machine according to claim 1 wherein said hood means comprises an outer hood member having a frusto-conical section defining the upper portion thereof and a generally circumferential section depending from the outer periphery of said frusto-conical section, said frusto-conical section having an opening in the top thereof immediately below and in operative communication with said suction fan means, said circumferential section being spaced radially outwardly of the periphery of said knitting section, and an inner hood member located within but spaced from said outer hood member and defining with said outer hood member said restricted air passageway.

9. A double knitting machine according to claim 8 wherein said inner hood member is at least partially frusto-conical.

10. A double knitting machine according to claim 9 wherein said hood means further comprises an extension extending downwardly from said circumferential section of said outer hood member into surrounding relation to said knitting section.

11. A double knitting machine according to claim 10 wherein said extension has access means therein providing operator access to said knitting section.

12. A double knitting machine according to claim 1 including waste collection means connected to the exhaust side of said suction fan means for receiving the air stream and entrained dust and other fiber waste from said suction fan means for collecting the dust and other waste therein.

13. A fiber waste removal system for a double knitting machine having a knitting section including a needle cylinder and a dial and yarn feeding and guiding means, said system comprising (a) suction fan means mounted above the knitting section and interiorly of said yarn feeding and guiding means for creating upwardly and inwardly flowing air streams through and across the knitting section and the yarn feeding and guiding means to remove dust and other fiber waste therefrom, and (b) hood means operatively associated with said suction fan means and overlying the knitting section of the double knitting machine and having an internal area greater than the area of the knitting section such that said hood means extends beyond the periphery of the knitting section, said hood means defining a restricted air passageway therethrough communicating with said suction fan means at one end and terminating in an ingress end at the other end thereof, said ingress end of said air passageway being in the outer portion of said hood means such that said ingress end will be located radially outwardly of and above the outer periphery of the knitting section so that the upwardly flowing air stream created by said suction fan means will flow upwardly from and outwardly beyond the knitting section into the ingress end of said air passageway and therethrough to said suction fan means.

14. A fiber waste removal system according to claim 13 including waste collection means connected to said suction fan means for receiving the air streams and entrained waste from said suction fan means for collecting the waste removed from the double knitting machine.

15. A fiber waste removal and collection system according to claim 14 wherein said hood means extends downwardly from and outwardly of said ingress opening to confine the upwardly and outwardly flowing air stream with said hood means.

16. A fiber waste removal and collection system according to claim 14 wherein said hood means comprises an outer hood member having a frusto-conical section defining the upper portion thereof and a generally circumferential section depending from the outer periphery of said frusto-conical section, said frusto-conical section having an opening in the top thereof immediately below said suction fan means, and an inner hood member mounted within said outer hood member in spaced relation thereto to define therewith said restricted air passageway.

17. A fiber waste removal and collection system according to claim 16 further including an extension carried by said circumferential section and extending downwardly therefrom to surround the knitting section of the double knitting machine.

* * * * *